US006627290B2

(12) United States Patent
Wittlinger et al.

(10) Patent No.: US 6,627,290 B2
(45) Date of Patent: Sep. 30, 2003

(54) SURFACE TREATMENT FOR FLOORS, WALLS OR CEILINGS

(75) Inventors: Gregory B. Wittlinger, Greensboro, NC (US); Robert H. Drake, Jr., East Alton, IL (US); Edward L. Herrin, Edwardsville, IL (US); Rita A. Godfrey, Greensboro, NC (US)

(73) Assignee: Burlington Industries, Inc., Greensboro, NC (US)

( * ) Notice: Subject to any disclaimer, the term of this patent is extended or adjusted under 35 U.S.C. 154(b) by 6 days.

(21) Appl. No.: 10/032,131

(22) Filed: Dec. 31, 2001

(65) Prior Publication Data

US 2003/0124297 A1 Jul. 3, 2003

(51) Int. Cl.[7] ..... B32B 3/10

(52) U.S. Cl. ..... 428/95; 428/62; 428/61; 428/44; 428/45; 16/7; 16/16; 52/396.04; 52/384

(58) Field of Search ..... 428/45, 44, 61, 428/62, 119, 86, 95, 96; 16/16, 4, 7; 52/396.04, 384, 386, 387

(56) References Cited

U.S. PATENT DOCUMENTS 2,926,378 A * 3/1960 Eichhorn et al. ..... 16/16
3,254,361 A * 6/1966 Brunn et al. ..... 16/16
4,092,450 A 5/1978 Haren
4,563,378 A * 1/1986 Roth ..... 428/86

FOREIGN PATENT DOCUMENTS

| | | | |
|---|---|---|---|
| GB | 1 498 079 | 1/1978 | |
| GB | 2 221 838 | 2/1990 | |
| GB | 2 278 542 | 12/1994 | |
| WO | WO 99/55954 | * 11/1999 | ..... 428/95 |

OTHER PUBLICATIONS

Research Disclosure 430102, Feb. 2000.

* cited by examiner

*Primary Examiner*—Alexander S. Thomas
(74) *Attorney, Agent, or Firm*—Nixon & Vanderhye

(57) ABSTRACT

Seam strips are provided in a textile covering for a floor, wall or ceiling which are exposed and afford an aesthetic surface treatment. The seam strips comprise inverted T-shaped strips with an upstanding web terminating in a margin short of the pile height and a pair of flanges projecting laterally from each of the lower opposite sides of the web. The flanges have holes for securing, by way of screws or nails, the strips to the underlying floor, wall or ceiling. The adjacent edges of the textile covering are secured to the upper surfaces of the flanges. The textile coverings preferably have the backstitches of tufts and portions of the primary backing forming an exposed surface which, together with the exposed margin of the strips, form an aesthetically pleasing surface treatment.

13 Claims, 7 Drawing Sheets

SURFACE TREATMENT FOR FLOORS, WALLS OR CEILINGS

BACKGROUND OF THE INVENTION

The present invention relates to a surface treatment for floors, walls or ceilings and particularly relates to broadloom or modular textile coverings having one or more seam strips forming complementary aesthetic design characteristics.

One form of conventional surface treatment is a textile covering, for example, a broadloom roll carpet or modular carpet. The terms "carpet" or "covering" are meant herein to embrace carpet applied to a floor, wall or ceiling. A principal and inherent deficiency in a carpet, particularly in commercial facilities, resides in the declining appearance retention of the aesthetic features of the carpet over long periods of time. For example, in commercial facilities, as well as in homes, carpet pile located adjacent doorways or high-traffic areas quickly mats down, with very noticeable adverse changes in appearance. Another example is conventional carpet used in locations where wheels and/or casters for chairs, carts and other items are frequently used. The appearance of the carpet in such areas degrades rapidly.

In a pending U.S. patent application, of common assignee herewith (Ser. No. 09/846,782, filed May 2, 2001, Attorney Docket 11-902), pending the disclosure of which is incorporated herein by reference, there is disclosed a surface treatment wherein the exposed surface, typically the wear surface of the covering, comprises in part the primary backing surf ace of the carpet which the carpet pile normally obscures. It will be appreciated that the primary backing, e.g., for a tufted pile carpet, typically serves as a support for the pile rather than to impart any aesthetics to the carpet. With most carpets, the primary backing is totally obscured by the pile and plays no role in the aesthetic design of the carpet. In the carpet construction disclosed in that patent application, the backstitches of the tufts and the exposed portions of the primary backing form the aesthetic part of the treatment surface. The resulting surf ace treatment provides a dense, low-profile surface which retains its textile aesthetics and enables rolling traffic, such as beds, chairs and the like, to move over the carpet without substantial degradation in the appearance of the carpet. In that example of carpet, the primary backing is tufted in certain areas in an inverted manner relative to the primary backing such that the backstitches of the tufts, together with exposed portions of the backing, form the exposed typical wear surface.

Further aesthetic enhancements to the appearance of a surface treatment are provide d in accordance with a preferred embodiment of the present invention by providing one or more seam strips intermediate side and end margins of the covering and which is particularly useful in the carpet of the above-identified patent application because of its very low pile. The seam strip is preferably formed of an inverted T-shaped cross-sectional configuration having an upstanding web and one or a pair of laterally extending flanges. The upstanding web terminates in a margin at or below the height of the pile and provides an exposed edge complementing the aesthetic characteristics of the exposed surface of the textile covering. The one or more lateral flanges underlie the adjacent edge(s) of the adjacent textile covering and preferably have apertures for securing the strip to the underlying floor, wall or ceiling. The edges of the textile covering at the seam may be adhered, for example, by an adhesive, to the strip.

As an example of the usage of the surface treatment of the present invention, roll carpet in strip form may be applied to the underlying floor, wall or ceiling, with the seam strips disposed along the adjoining edges, i.e., the seams, of the textile covering strips. Consequently, an overall aesthetic appearance may be provided by exposing to view the marginal edges of the webs of the seam strips in conjunction with the exposed surface of the carpet. For example, by employing the primary backing of the textile covering and the backstitches of the tufted yarns exposed through the primary backing as in the covering disclosed in the above-identified patent application in conjunction with the marginal edges of the webs of the seam strips, an aesthetically pleasing appearance may be obtained. It will be appreciated that the seam strips, particularly the exposed marginal edges of their webs, can be provided in various colors complementary to the aesthetic characteristics of the textile covering. It will also be appreciated that various designs using the seam strip can be imparted to the textile covering. For example and as previously noted, the seam strips may lie parallel to one another at the seams between adjacent carpet strips forming a covering. Alternatively, carpet tiles may be formed with the seam strips intersecting one another at right angles forming a checkerboard pattern. Various other patterns will be appreciated by those of skill in this art.

In a preferred embodiment according to the present invention, there is provided a surface treatment for a floor, wall or ceiling, comprising a textile covering for overlying the floor, wall or ceiling and having a seam between adjacent portions thereof, the covering having an exposed planar surface opposite a surface thereof in overlying registration with the floor, wall or ceiling, an elongated strip having an upstanding web with an upper margin and at least one flange extending laterally from a side and along a lower portion of the web, the flange underlying at least one marginal edge of the covering adjacent the seam, the web extending upwardly from the flange between the marginal edges and terminating at or short of the exposed planar surface, the upper margin of the web being exposed through the exposed planar surface of the textile covering and forming with the textile covering an exposed decorative surface.

DETAILED DESCRIPTION OF THE INVENTION

Figure 1:
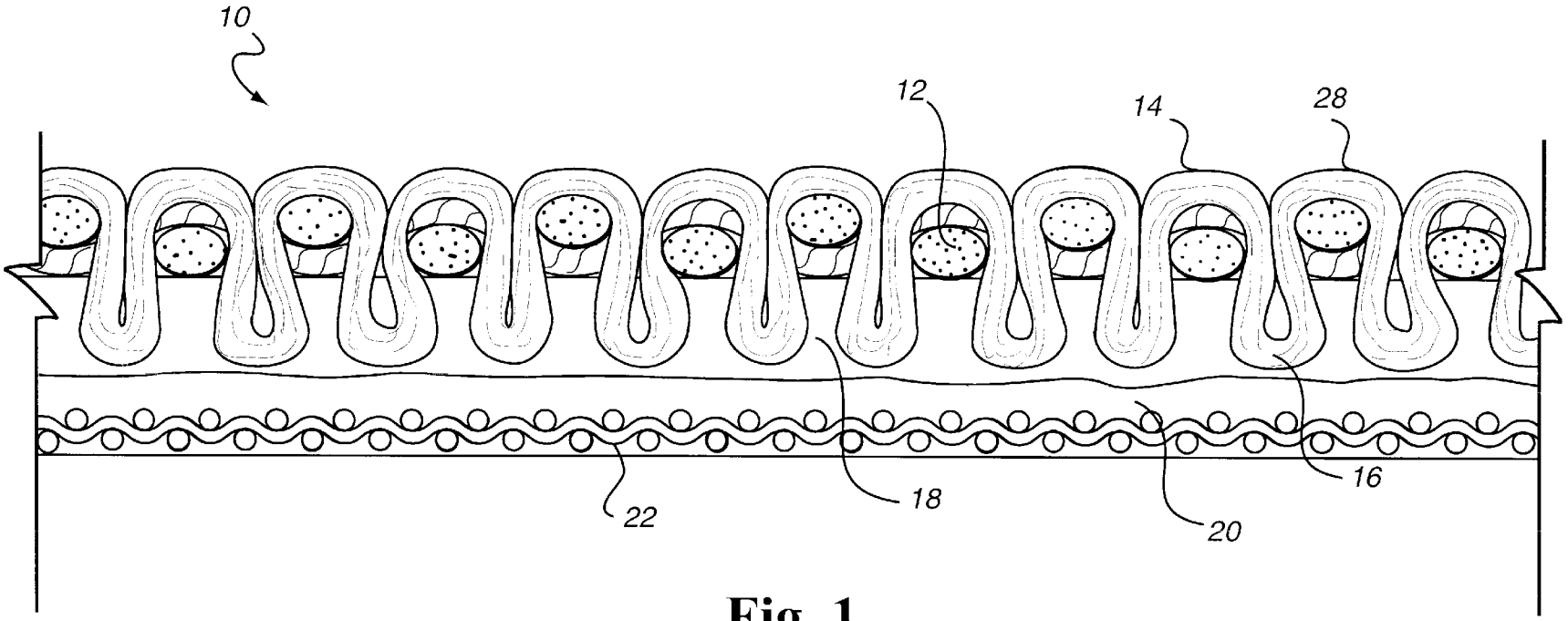
FIGS. 1–3 are schematic cross-sectional views of a textile covering construction which, in combination with the seam strip, constitutes a preferred embodiment of the surface treatment of the present invention.

Referring now to the drawings, particularly to FIG. 1, there is illustrated a covering, generally designated 10, representative of various coverings useful in the surface treatment constructed in accordance with a preferred embodiment of the present invention. The covering 10 includes a woven polypropylene primary backing 12 which is tufted in a conventional manner by passing textured or untextured continuous filament or spun yarns 14 through the woven backing, forming looped yarns 16 along the underside of the primary backing 12. The tufting process is conventional and any type of fiber may be utilized for the yarn being tufted, for example, a polyester, polyolefin, such as polyethylene or polypropylene, polylactic acid or polyamid, such as nylon, as desired. Moreover, while tufted continuous loop yarns 16 are illustrated on the back side of the primary backing 12, it will be appreciated that the loops or loop yarns 16 may comprise cut pile yarns along the back side of the primary backing 12. The woven primary backing also has an ultraviolet (UV) stabilizer to protect against the degrading effect of ultraviolet rays. That is, the primary backing is formed preferably of a woven polypropylene with a UV stabilizer added during extrusion of the polypropylene yarn forming the primary backing.

A resin 18 is applied along the back side of the primary backing and coats, encapsulates and saturates the loops 16 to lock the loop yarns in place. A Unibond® backing or coating is then applied over the resin-coated, continuous loop yarns 16. The Unibond® coating 20 comprises a mixture of ethylvinyl acetate (EVA), calcium carbonate and a resin. The Unibond® coating is applied as a hot melt composition over the resin 18. While the hot melt is still in a liquid or plastic condition, a secondary backing, preferably a woven polypropylene scrim 22, is applied to the Unibond® coating 20. The carpet construction is then passed over a chill table to set and solidify the Unibond® coating and secure the secondary backing 22 in the carpet construction. The secondary backing 22 provides integrity and dimensional stability to the covering.

Figure 5:
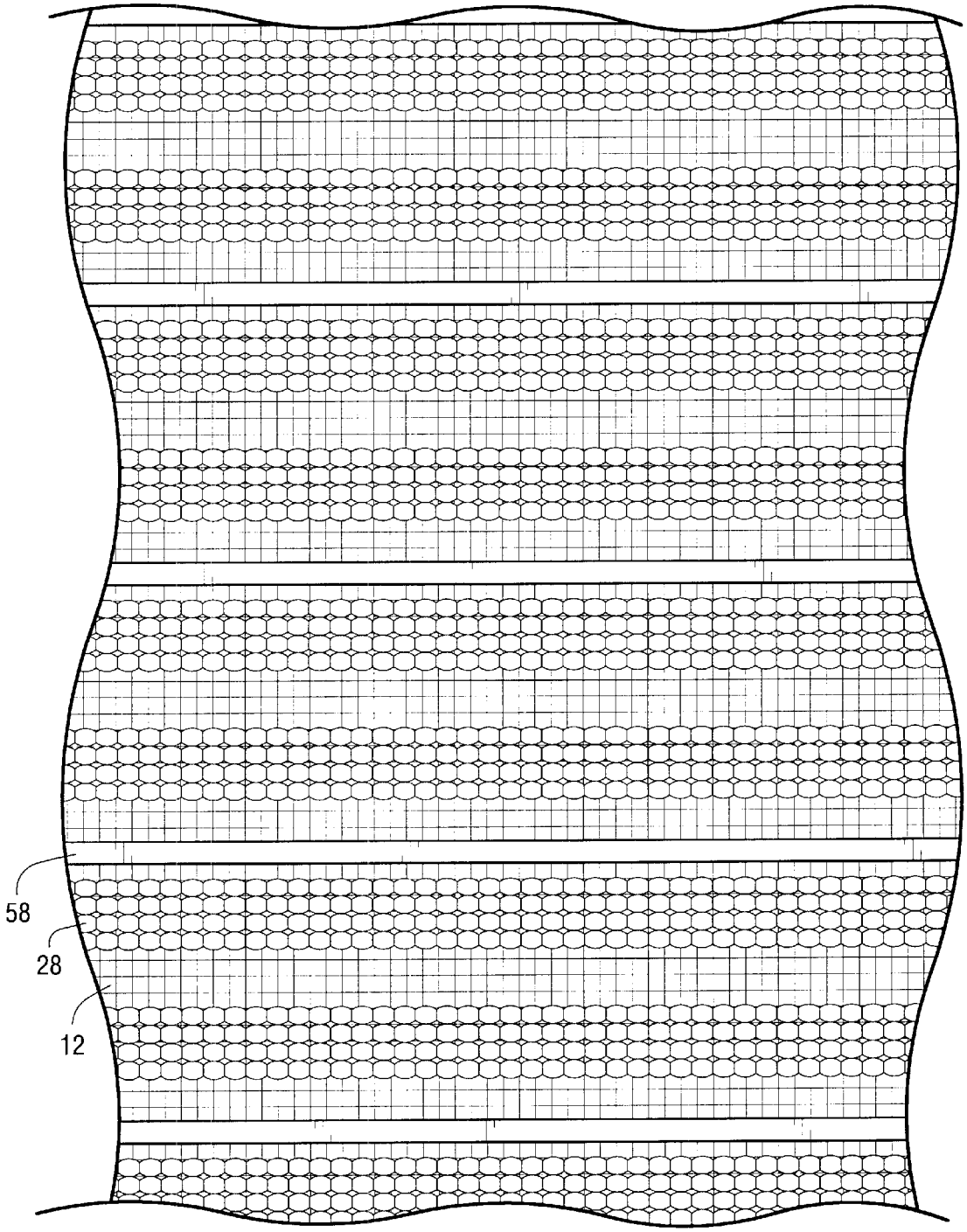
FIGS. 5–7 illustrate various representative aesthetic designs of the surface treatment including the seam strip and textile covering hereof.
Figure 6:
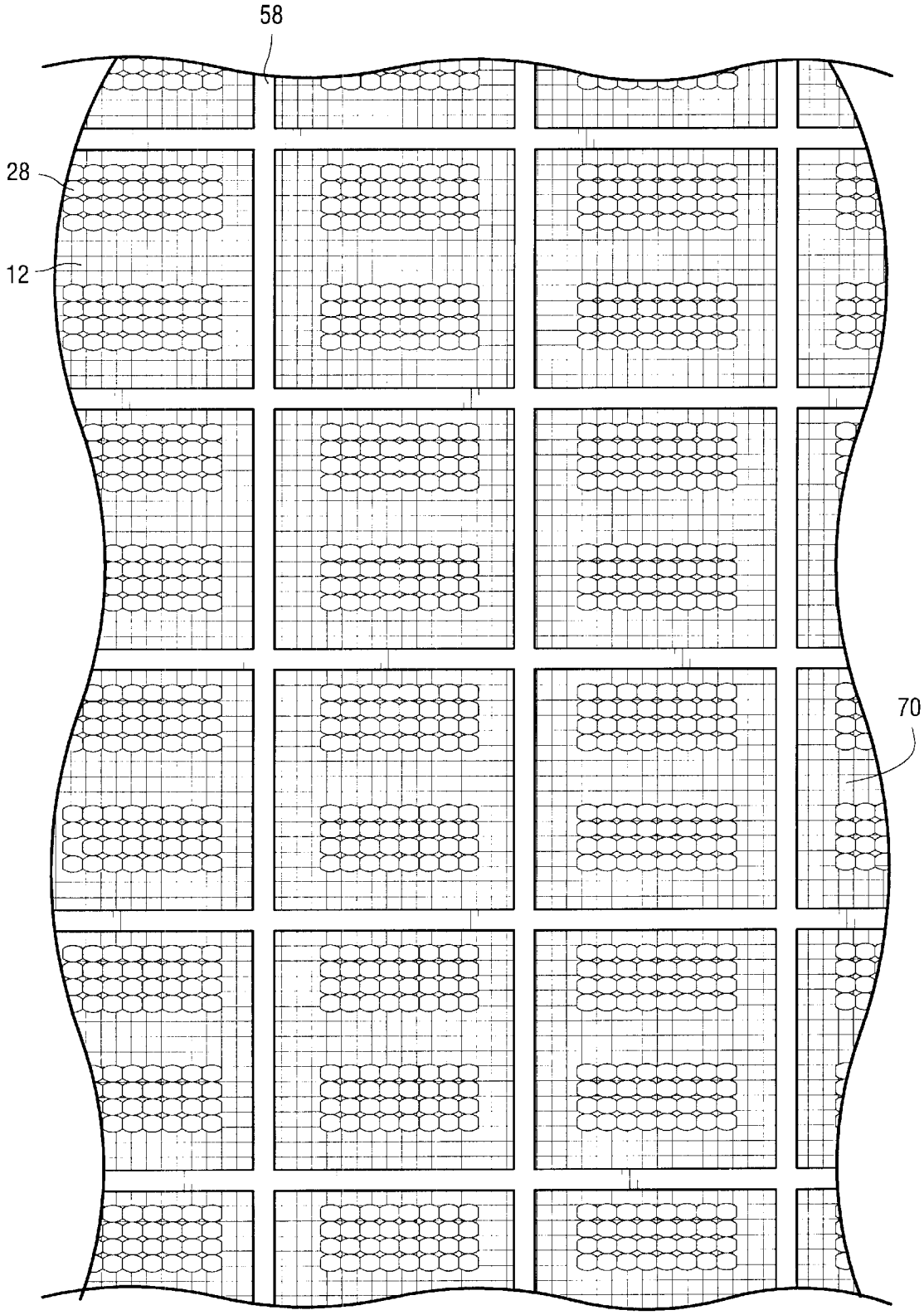
Figure 7:
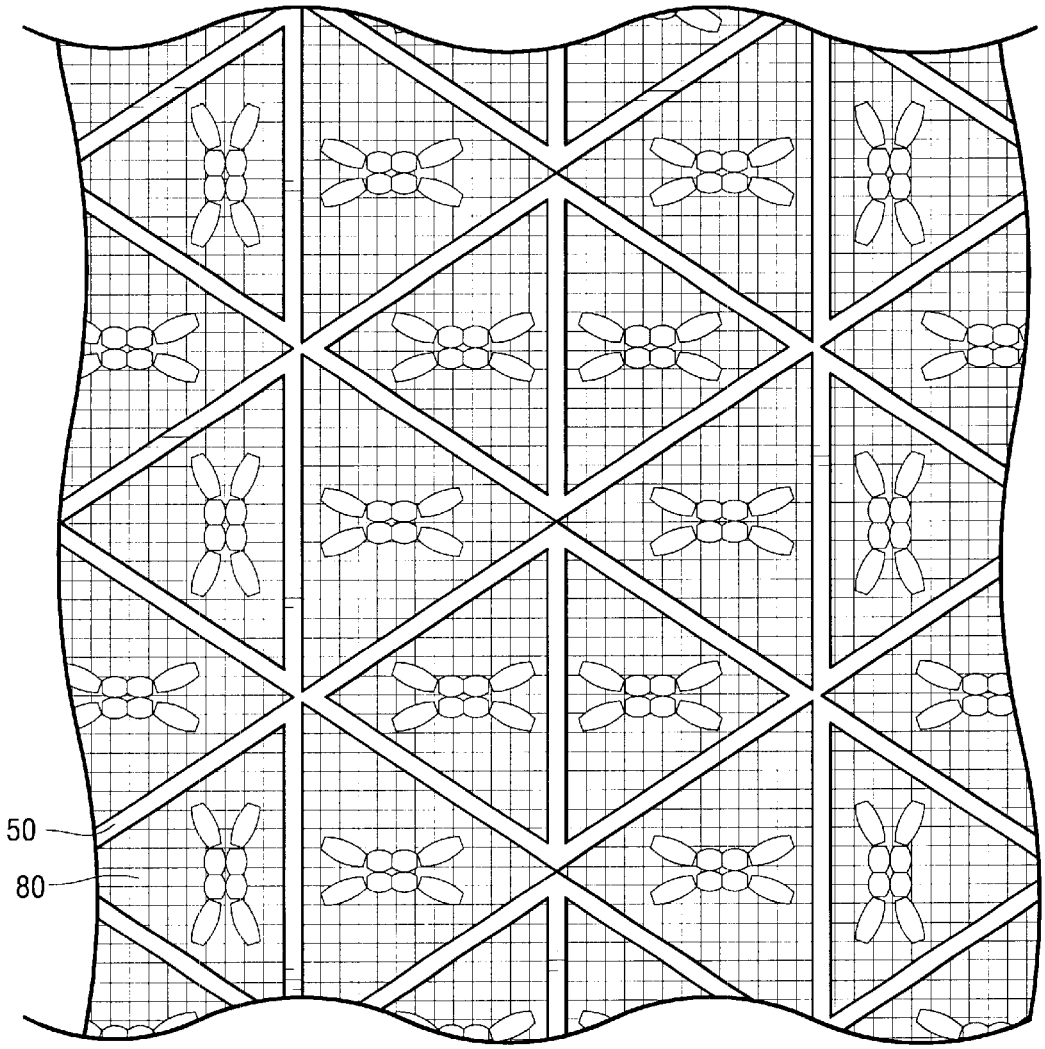

From a review of FIGS. 5–7, it will be appreciated that the backstitches 28 of the tufted yarns 14 are exposed through the primary backing 12 and form part of the textile wear surface. Moreover, each backstitch 28 is tufted tightly such that it is in substantial continuous contact with the woven polypropylene primary backing 12 for the entirety of its length exposed through the primary backing 12 on the wear surface.

Figure 2:
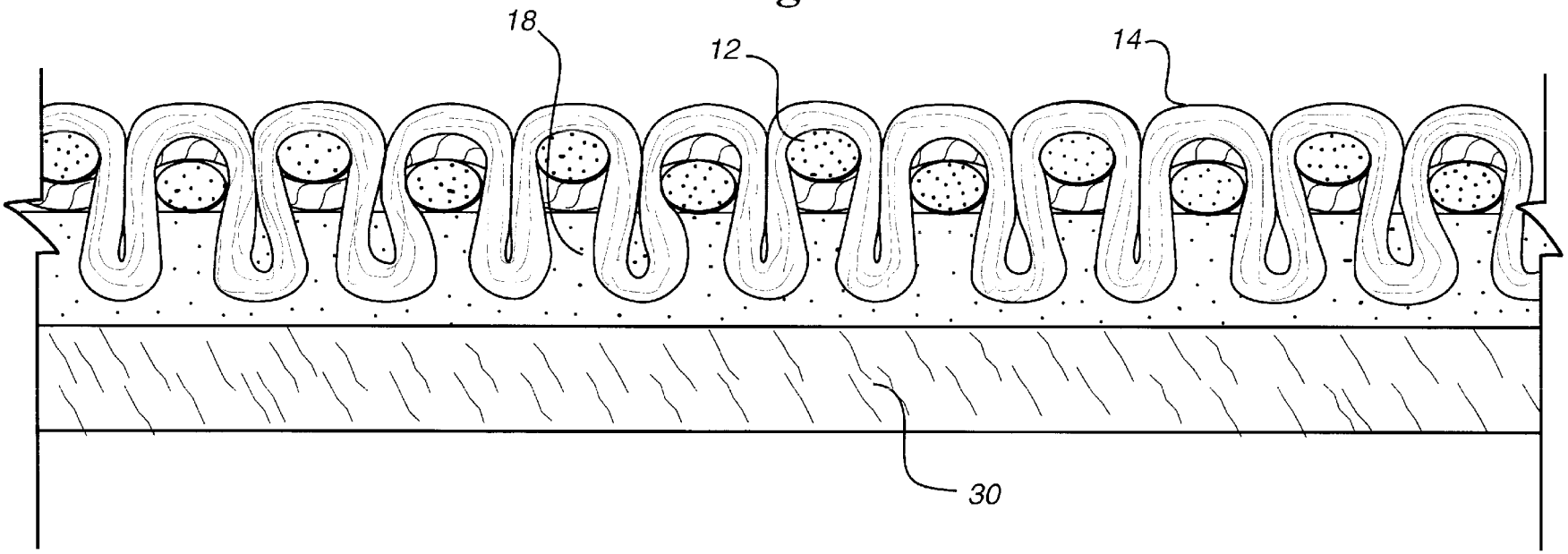

To provide an enhanced cushioning effect, and referring to FIG. 2, there is illustrated a woven primary backing 12 tufted with continuous loop yarns 14, which are coated on the underside by a resin 18, similarly as in FIG. 1. In this form, however, a needle-bonded synthetic fibrous maincoat mat 30 underlies the resin coating 18. The needle-bonded synthetic fibers forming mat 30 may comprise nylon and polypropylene in a cut mixture thereof and mixed with a resin. Preferably, all, none or a proportion of the cut fibers may be formed from waste material from other carpet manufacturing streams.

Figure 3:
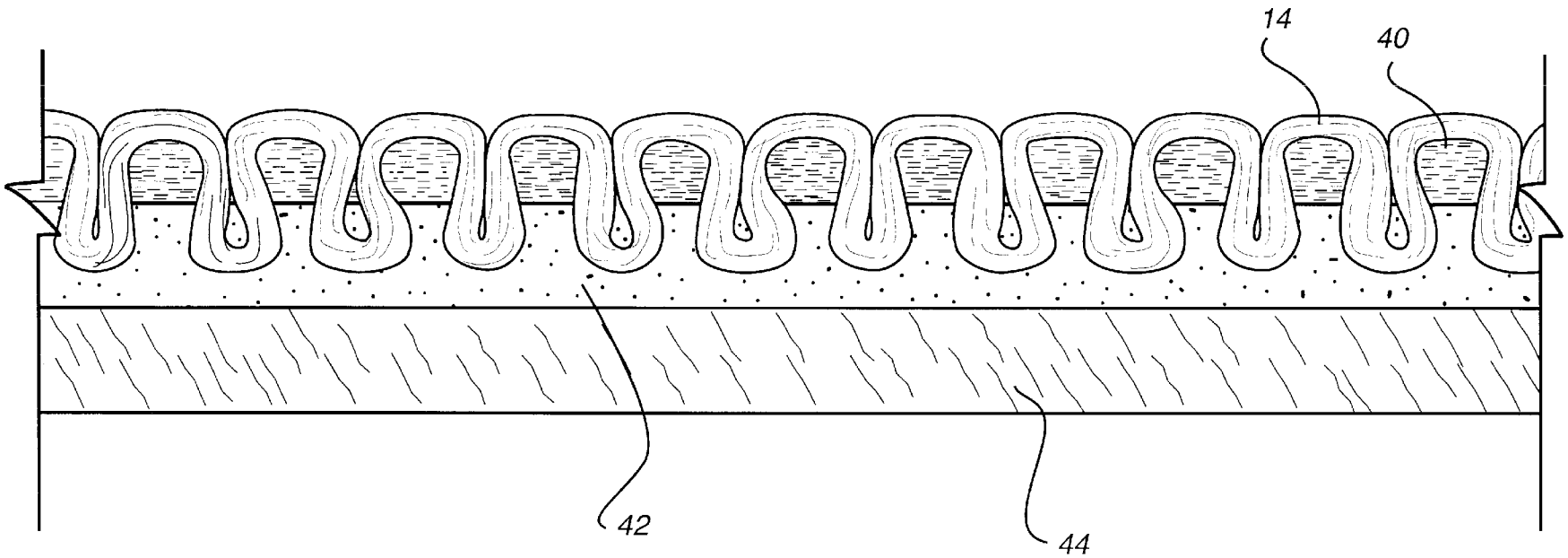

Referring now to FIG. 3, and in lieu of a woven polypropylene primary backing 12, there is provided a non-woven primary backing 40, particularly useful for modular carpeting, i.e., carpet tiles. The non-woven primary backing is preferably formed of a mixture of nylon and polyester fibers. Those fibers are reduced and mixed together and passed between heated rolls to flatten the fibers and form a composite flat sheet structure. The polyester fibers essentially bond the nylon fibers to one another. This sheet may then be tufted, with either the cut or continuous loop yarns 14, to form a highly dimensionally stable primary backing.

While it is possible to provide the non-woven primary backing with either the Unibond® material and the woven scrim as a secondary backing or the needle-bonded synthetic fiber backing, the non-woven backing is not necessary for broadloom carpeting. Preferably, and for use in modular carpeting, a PVC backing is provided to the non-woven primary backing. Particularly, a PVC precoat 42 is applied to the tufted yarn loops 14 to trap and lock the loops in place along the underside of the non-woven primary backing 40. A main coat 44 of heavier PVC is then applied, together with a fiberglass stabilizer layer for additional stability. The above carpets are representative of the type of carpets which may be used in the present invention which is not limited thereto. Other types of conventional carpets may be used as part of the present invention.

Figure 4:
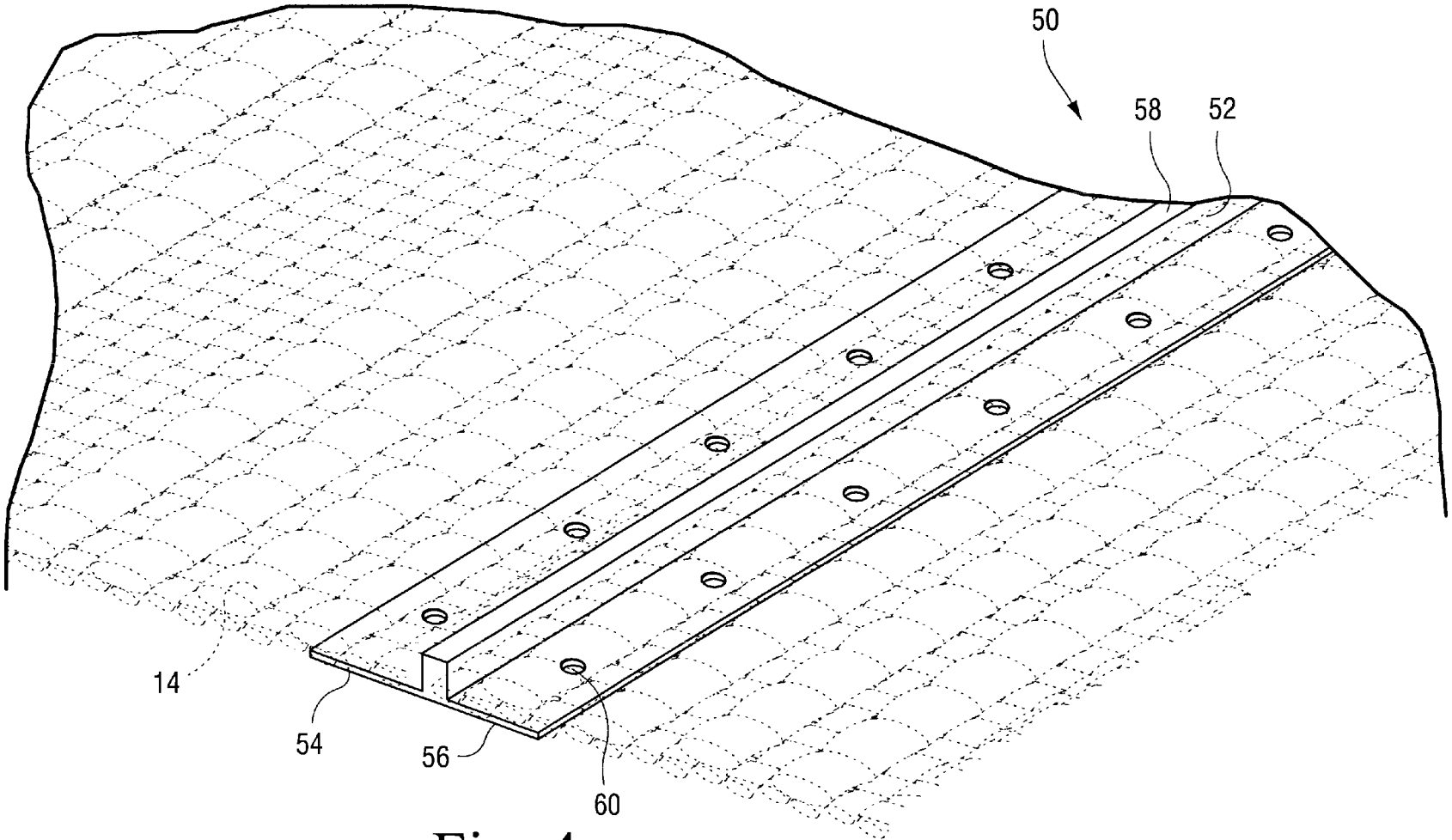
FIG. 4 is a fragmentary perspective view illustrating the textile covering and seam strip combination with the seam strip applied along a seam of the textile covering.

Referring now to FIG. 4, there is illustrated a seam strip in combination with a textile covering of the type previously described, the seam strip being generally designated 50, useful to form an aesthetically pleasing surface treatment. The seam strip 50 comprises a generally inverted T-shaped, elongated strip having a generally upstanding web 52 and one and preferably a pair of flanges 54 and 56 projecting laterally from opposite sides and lower portions of the web 52. The upper margin 58 of the web terminates at or just short of the upper surface of the pile, e.g., the backstitches 14. Preferably, the strip 50 is formed of a metal material such as aluminum. The face margin 58 is also finished to provide an aesthetically pleasing appearance in combination with the exposed surface of the textile covering. For example, the exposed margin 58 may be a burnished aluminum surface or may be colored or textured in a manner complementary to the aesthetics of the exposed surface of the textile covering.

The flanges 54 and 56 preferably have holes 60 at spaced intervals therealong for receiving nails, screws or other types of fasteners to secure the seam strip to the floor, wall or ceiling. Alternatively, the strip may be adhesively secured to the floor, wall or ceiling.

It will be appreciated that the margins of the textile covering on opposite sides of the seam strip 50 overlie the flanges 54 and 56 and butt up against the sides of the web 52. Margins of the textile covering may be adhesively secured along the upper surface of the flanges.

In a preferred embodiment of seam strip hereof, the strip may have an overall width of 1⅛ inches, with the flanges having a depth of 0.040 inches. The web 52 may project 0.230 inches from the bottom face of the seam strip to the margin 58 and the width of the web may be 0.110 inches. It will be appreciated that the length of the strip can be variable as the installation requires. For example, the strip may be provided in 12-foot lengths. Thus, in FIG. 5, the seam strips are provided in the seams between adjacent covering strips. The coverings may be provided in roll form of various widths, for example, 4, 6 or 8-foot widths, with the steam strips extending in the lengthwise direction of the installation of the covering in roll form. Thus, the seam strips are provided between covering strips and are therefore located and appear within the extent of the covered area.

Referring to FIG. 6, it will be appreciated that the surface treatment may be provided in the form of tiles, for example, rectilinear carpet tiles 70, with the seam strips provided along the tile edges and at right angles relative to one another. In this configuration, the web adjacent the junctures of the right-angularly-related seam strips can be undercut such that the seam strips lie at a constant elevation within the overall surface treatment. Thus, the web of one seam strip may overlie a flange of a continuously extending, right-angularly-related, elongated seam strip to provide continuity of the margins in a grid pattern as illustrated.

Other designs may, of course, be provided. For example, in FIG. 7, covering tiles 80 may be provided in triangular form with the seam strips extending along the seam between adjacent margins of the triangularly-shaped tiles.

It will be appreciated that various other aesthetic characteristics may be provided to the covering using the combination of a textile covering and seam strip. With the backstitches of the tufts forming a portion of the exposed wear surface and the primary backing also forming a portion of the exposed wear surface in a preferred textile covering hereof, the combination of the backstitch, primary backing portion and margin of the seam strips affords numerous aesthetically pleasing design possibilities. Note also the enhanced structural reinforcement provided by the seam strips. Moreover, because the low pile provides reduced cushioning in comparison with conventional high-pile constructions, the metal seam strips along the seams of the covering (interior to the margins of the entire covering) do not provide obstructions to passage of wheels or casters and do not afford any substantially different feel underfoot than the low-pile construction. Also, the exposed margins of the seam strips can be colored or textured to complement the aesthetic characteristics of the adjoining textile covering.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A surface treatment for a floor, wall or ceiling, comprising:

a textile covering for overlying the floor, wall or ceiling and having a seam between adjacent portions thereof, said covering having an exposed planar surface opposite a surface thereof in overlying registration with the floor, wall or ceiling;

an elongated unitary strip having an upstanding web with an upper margin and flanges extending laterally from opposite sides of said web and along lower portions of said web, said flanges underlying marginal edges of said covering adjacent said seam, said web extending upwardly from said flanges between said marginal edges and terminating at or short of said exposed planar surface, said marginal edges abutting upstanding opposite side walls of said web, respectively, said upper margin of said web being exposed through said exposed planar surface of said textile covering and forming with the textile covering an exposed decorative surface, said marginal edges of said covering and said flanges being adhesively secured to one another.

2. A surface treatment according to claim 1 wherein said flanges extend continuously along said strip.

3. A surface treatment according to claim 1 wherein said flanges are formed of metal.

4. A surface treatment according to claim 1 wherein said margin of said web terminates short of said exposed planar surface.

5. A surface treatment according to claim 1 wherein each of said flanges has a lateral extent at least twice the width of said web.

6. A surface treatment according to claim 1 wherein at least one of said flanges has a plurality of openings for receiving fasteners for securing the strip to the floor, wall or ceiling.

7. A surface treatment according to claim 1 wherein said strip is formed of metal and said flanges extend continuously along opposite sides of said strip, said flanges each having a lateral extent at least twice the width of said web, said margin of said web terminating short of said exposed planar surface of said covering, said flanges having a plurality of openings for receiving fasteners for securing the strip to the floor, wall or ceiling, said marginal edges of said covering and said flanges being adhesively secured to one another.

8. A surface treatment according to claim 1 wherein said textile covering has a second seam between second adjacent portions thereof, a second elongated strip having an upstanding second web with an upper margin and flanges extending laterally from opposite sides and along a lower portion of said second web, the flanges of said second strip underlying marginal edges of said second adjacent portions of said covering adjacent said second seam, said second web extending upwardly from the flanges of said second strip between marginal edges of the covering forming the second seam and terminating at or short of said exposed planar surface, said upper margin of said second web being exposed through said exposed planar surface of said textile covering to form with the textile covering an exposed decorative surface.

9. A surface treatment according to claim 8 wherein said strips lie generally parallel to one another.

10. A surface treatment according to claim 8 wherein said strips lie at angles relative to one another.

11. A surface treatment according to claim 8 wherein said textile covering is in the form of tiles of said textile covering bounded on all sides by said strips.

12. A surface treatment according to claim 1 wherein said textile covering includes a primary backing in part exposed on one side of the covering for forming discrete wear surface portions of a wear surface of the covering, a plurality of yarns tufted into said primary backing along remaining parts of said primary backing forming cut or loop yarns on a back side of said primary backing remote from said wear surface, leaving a plurality of backstitches of the tufted yarns along and forming remaining portions of said exposed wear surface, and a resin fixing said cut or loop pile tufted yarn along the back side of said primary backing, said backstitches and said primary backing portions exposed along said exposed wear surface having aesthetic characteristics distinguished from one another and forming with said margin of said web the decorative exposed surface of said covering.

13. A surface treatment according to claim 1 wherein said textile covering includes a woven primary backing having tufted and non-tufted portions on one side thereof exposed for forming discrete wear surface portions of a wear surface of an exposed wear surface of the covering, said tufted portions including a plurality of yarns tufted into said primary backing and formed of cut or loop yarns on a back side of said primary backing remote from said wear surface, leaving a plurality of backstitches of the tufted yarns along and forming part of said wear surface and a resin fixing said cut or looped tufted yarns along the back side of said primary backing, said non-tufted portions comprising warp and weft yarns of said primary backing, said tufted and non-tufted portions of said primary backing exposed along said wear surface having aesthetic characteristics distinguished from one another.

* * * * *